US006794802B2

(12) United States Patent
Pollner

(10) Patent No.: US 6,794,802 B2
(45) Date of Patent: Sep. 21, 2004

(54) SPARK PLUG FOR AN INTERNAL COMBUSTION ENGINE AND METHOD FOR PRODUCING A SPARK PLUG

(75) Inventor: Rudolf Pollner, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/088,619

(22) PCT Filed: May 4, 2001

(86) PCT No.: PCT/DE01/01703

§ 371 (c)(1),
(2), (4) Date: Jul. 19, 2002

(87) PCT Pub. No.: WO02/09247

PCT Pub. Date: Jan. 31, 2002

(65) Prior Publication Data

US 2003/0020388 A1 Jan. 30, 2003

(30) Foreign Application Priority Data

Jul. 25, 2000 (DE) ..... 100 36 008

(51) Int. Cl.[7] ..... H01T 13/02; H01T 13/00; H01T 13/20; H01T 21/02

(52) U.S. Cl. ..... 313/131 A; 313/130; 313/118; 313/137; 313/141; 313/143; 445/7; 123/169 R; 123/169 EL

(58) Field of Search ..... 313/130, 131 A, 313/118, 137, 141, 143, 128, 129; 445/7; 123/169 R, 169 EL

(56) References Cited

U.S. PATENT DOCUMENTS

| | | | | | |
|---|---|---|---|---|---|
| 4,183,746 | A | * | 1/1980 | Pearce et al. | 75/234 |
| 4,659,960 | A | * | 4/1987 | Toya et al. | 313/141 |
| 5,055,442 | A | * | 10/1991 | Osaka et al. | 502/439 |
| 5,852,340 | A | * | 12/1998 | Ito et al. | 313/141 |
| 6,160,342 | A | * | 12/2000 | Nishikawa et al. | 313/137 |

FOREIGN PATENT DOCUMENTS

| | | | |
|---|---|---|---|
| DE | 198 53 844 | A | 5/2000 |
| EP | 0 482 897 | A | 4/1992 |
| WO | 97 49153 | A | 12/1997 |

* cited by examiner

*Primary Examiner*—Nimeshkumar D. Patel
*Assistant Examiner*—Sharlene Leurig
(74) *Attorney, Agent, or Firm*—Michael J. Striker

(57) ABSTRACT

The seal between the insulator and the center electrode is to be improved in a spark plug for an internal combustion engine comprising a shell (12), an insulator (16) located in the shell and composed of a sintered ceramic material, as well as a center electrode (18) and a terminal stud (22) that have an electrically conductive connection with each other and are located in the insulator. For this purpose, it is provided that a cermet (28) abuts the center electrode, the ceramic phase of which is composed of the same or a similar material as the insulator, and the metallic phase of which is composed of a material having good electrical conductivity. Since the material properties of the cermet are similar to those of the insulator—the thermal expansion, in particular, is same—a particularly good seal is created between the cermet and insulating body.

20 Claims, 3 Drawing Sheets

SPARK PLUG FOR AN INTERNAL COMBUSTION ENGINE AND METHOD FOR PRODUCING A SPARK PLUG

BACKGROUND OF THE INVENTION

The invention concerns a spark plug for an internal combustion engine, comprising a shell, an insulator located in the shell and composed of a sintered ceramic material, as well as a center electrode heat-fused into an insulator, and a terminal stud that have an electrically conductive connection with each other and are located in the insulator. The invention further concerns a method for producing a spark plug.

Due to the different thermal expansions of platinum and ceramic material, spark plugs comprising a platinum center electrode heat-fused into an insulator have a slight gap between the ceramic and the center electrode that allows air or combustion gases to penetrate. For this reason, the components in the interior of the spark plug must be stable in the presence of these gases. It is therefore impossible, for example, to install a carbon-based burn-off resistor in the anterior region of the spark plug on the combustion chamber side, because the carbon would be oxidized at the high temperatures by the penetrating atmospheric oxygen. Additionally, contact pins must be made of materials that are stable in the presence of the penetrating gases. Contact pins having high thermal conductivity, e.g., those made of copper, can therefore not be used.

A spark plug is made known in WO 97/49153, about which it is proposed that the contact pin be replaced with an electrically conductive ceramic-metal mixture in order to prevent mechanical stresses, because the coefficients of thermal expansion would then be the same.

The object of the invention is to further develop a spark plug of the type described initially such that a gas-tight, reliable seal is ensured that can be produced cost-effectively. The object of the invention is further to create a method for producing such a spark plug.

SUMMARY OF THE INVENTION

With the spark plug of the present invention, the insulator and the cermet have the same or similar material properties, which ensures sealing. The fact that the material properties are the same yields advantages for production as well as operation: insulator and cermet can be easily sintered together, because they have the same shrinkage behavior. Since insulator and cermet also have the same thermal expansion, no gaps are produced as a result of different thermal expansions. As a result of the good seal that is achieved, materials can be used in the anterior region of the spark plug that are not sufficiently stable in the presence of air or combustion gases at the high temperatures occuring during operation, e.g., resistors having carbon as the conductive phase or contact pins made of copper and having good thermal conductivity. Only a relatively small quantity of metal is needed for the metallic phase of the cermet, which results in low costs for the spark plug.

According to a preferred exemplary embodiment of the invention, it is provided that the ceramic phase of the cermet is composed of $Al_2O_3$, and the metallic phase is composed of platinum or a platinum alloy. This cermet can be easily sintered together with the insulator, because it comprises the same sintering properties as the insulator.

According to a preferred exemplary embodiment of the invention, it is provided that a ceramic granulated material is used to produce the cermet, the granules of which are provided with a surface coating of a material having good electrical conductivity. Due to the difference in size between the granules of the granulated material—which preferably have a diameter in the range between 90 $\mu$m and 150 $\mu$m—and the pulverized material—the particles of which are less than 10 $\mu$m in size, a ceramic micro-structure results after sintering having a network of thin metal tracks, e.g., made of platinum, that ensures sufficient electrical conductivity despite the small quantity of metal used. It is sufficient, for instance, for the metallic phase of the cermet to constitute a quantity between 10 and 15% by volume. The precious metal that is preferably used is therefore used sparingly.

Reference is made to the explanations hereinabove with regard for the advantages achieved with the method according to the invention.

According to a preferred exemplary embodiment of the method, it is provided that the granules of the ceramic granulated material are coated with the material having good electrical conductivity by stirring in a diluted suspension. In this fashion, the granules can be coated with the electrically conductive material, e.g., platinum, in cost-effective fashion, so that the electrically conductive network is produced in the interior of the cermet after the granulated material is sintered. As an alternative, the material having good electrical conductivity can also be applied to the granules of the granulated material using an organic binding agent, for instance, or it can be applied via vapour deposition or sputtering.

BRIEF DESCRIPTION OF THE DRAWINGS

The invention is described below using a preferred exemplary embodiment shown in the attached drawings.

DETAILED DESCRIPTION OF THE EMBODIMENTS

Figure 1:
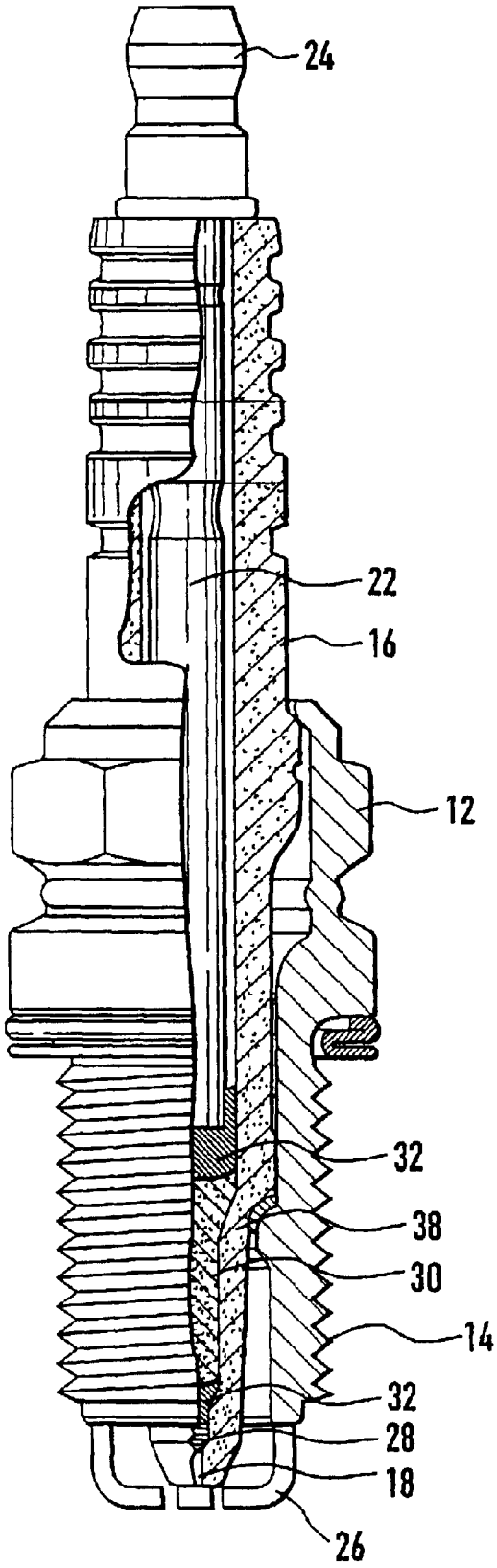
FIG. 1 shows a partial sectional view of a spark plug according to the invention.

A spark plug 10 is shown in FIG. 1 that comprises a shell 12 composed of metal and having threads 14, by means of which the spark plug can be screwed into a bore in a cylinder head of an internal combustion engine. An insulator 16 is housed in the interior of the shell 12, which is composed of a sintered ceramic material such as $Al_2O_3$. A center electrode 18 and a terminal stud 22 that have an electrically conductive connection with each other are housed in the interior of the insulator. A spark can therefore be produced in known fashion between the center electrode 18 and ground electrodes 26 attached to the shell 12 by applying a voltage potential between a terminal nut 24 screwed onto the terminal stud 22 and the shell 12.

The seal and the electrically conductive connection between terminal stud 22 and center electrode 18 is designed as follows: a cermet 28 abuts the center electrode 18, which is followed by a burn-off resistor 30 (with a contact set between them, if necessary), followed by a contact set 32 that is penetrated by the terminal stud 22.

Figure 2:
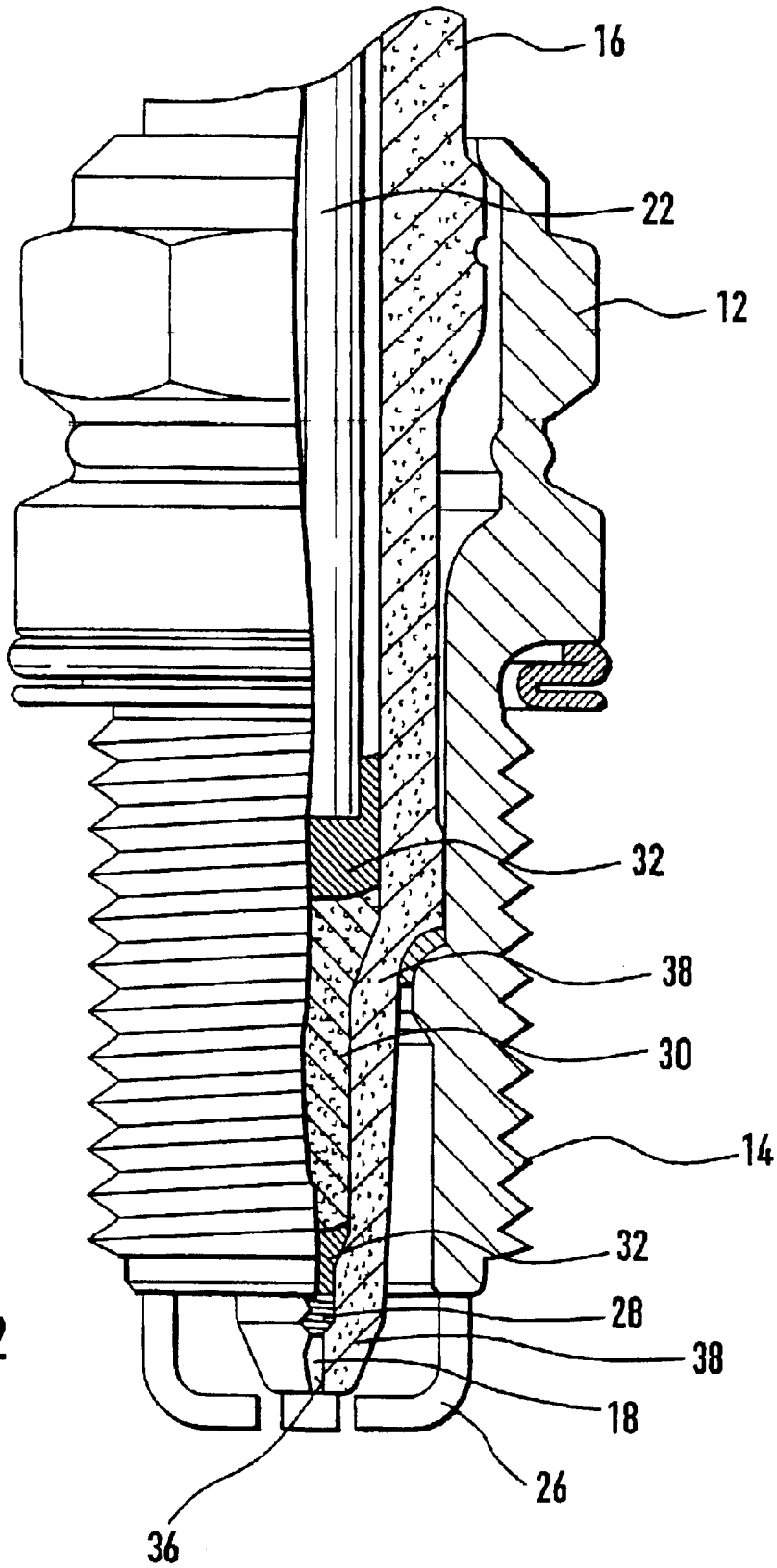
FIG. 2 shows an enlarged view of a section in FIG. 1.
Figure 3:
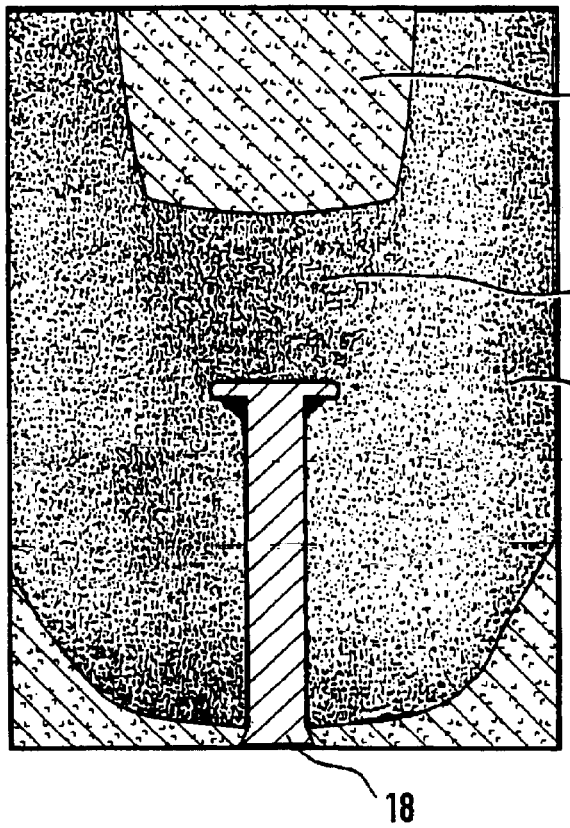
FIG. 3 shows an enlarged micrograph of a part of the insulator of the spark plug according to the invention with center electrode heat-fused into an insulator.
Figure 4:
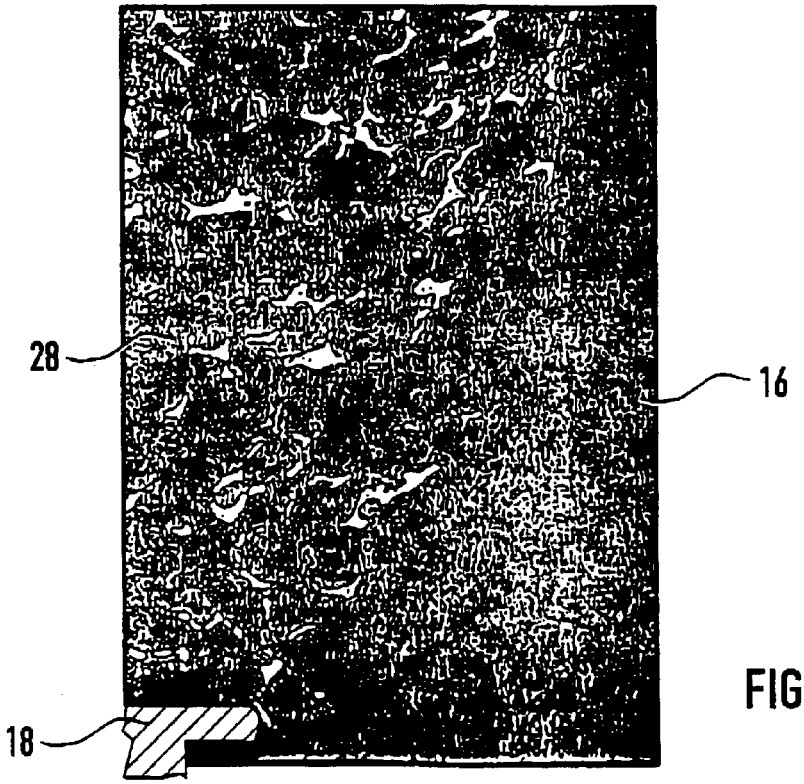
FIG. 4 shows an enlarged section of the micrograph in FIG. 3.

The gas-tight seal is described below in detail using FIGS. 2 through 4.

The insulator 16 comprises an offset bore in its interior, the anterior end 36 of which houses the center electrode. The center electrode—which is preferably composed of fine grain-stabilized platinum or a fine grain-stabilized platinum alloy—comprises a nail head 38 that rests on the shoulder toward the greater bore diameter. The center electrode is heat-fused into the insulator and is sealed over the nail head by the cermet 28 and additionally fixed in position. The cermet 28 is composed of ceramic material and a metallic phase. The same material is used for the ceramic phase as for the insulator, i.e., $Al_2O_3$ having the known additives of sintering auxiliary agents, such as $SiO_2$, CaO, MgO, etc. Platinum or a platinum alloy is used for the metallic phase.

The cermet is produced starting with a granulated material of the insulator material having a granule size between 90 μm and 150 μm. The granules of the ceramic granulated material are then coated with the platinum or platinum alloy serving as electrical conductor, e.g., by stirring in a mixer with a diluted platinum suspension, and then drying. The platinum or the platinum alloy is present in the suspension in powder form; the individual granules are less than 10 μm in size. In this fashion, granules are obtained that are coated with a small quantity of platinum or the platinum alloy. In order to achieve the electrical conductivity needed later on, it has proven sufficient if the quantity of platinum or platinum alloy constitutes 10 to 15% by volume of the cermet.

The ceramic granulated material coated in this fashion is filled into the insulator—which was produced using a usual method and may have been pre-annealed at a temperature of 1000° C. to increase hardness—so that it lies above the nail head 38 of the center electrode 18 inserted in the location hole 38. The granulated material is then compressed using a stamp using a force of approximately 100 to 150 N. Finally, the insulator is sintered together with the granulated material at approximately 1600° C., in the usual fashion. This results in a very good bond between the insulator and the cermet, because the same material is used as the basic material for the cermet as for the insulator, and good electrical conductivity of the cermet is produced due to the platinum or the platinum alloy, because a network of thin tracks of platinum or the platinum alloy is produced during sintering. This is shown in the micrographs in FIGS. 3 and 4. A nearly uniform micro-structure of insulator 16 and cermet 28 is produced, which differs only in terms of the platinum or platinum-alloy tracks present in the cermet 28.

Since the same material is used for the ceramic phase of the cermet as for the insulator, a particularly good seal is produced on the back side of the center electrode 18. This seal is also maintained over long service lifes, because the cermet and the insulator have the same thermal expansion, so no thermal stresses and cracks or gaps resulting therefrom can occur. Carbon can therefore be used, for example, as electrically conductive material for the burn-off resistor 30, even though this material is not sufficiently stable in the presence of air or combustion gases at the operating temperatures; the seal is so reliable that the carbon does not come in contact with the air or the combustion gases.

What is claimed is:

1. A spark plug for an internal combustion engine with a combustion chamber, comprising a shell (12), an insulator (16) located in the shell and composed of a sintered ceramic material, as well as a center electrode (18) heat-fused in an insulator, and a terminal stud (22) that have an electrically conductive connection with each other and are located in the insulator, wherein a cermet (28) abuts the center electrode, wherein a ceramic phase of the cermet is composed of the same or a similar material as the insulator, wherein a metallic phase of the cermet is composed of a material having good electrical conductivity, and wherein the cermet is disposed between the center electrode and the terminal stud, wherein a burn-off resistor (30) is located in the interior of the insulator, and wherein a conductive phase of the burn-off resistor is composed of carbon.

2. The spark plug according to claim 1, wherein the ceramic phase is composed of $Al_2O_3$.

3. The spark plug according to claim 2, wherein the ceramic phase comprises sintering auxiliary agents.

4. The spark plug according to claim 1, wherein the metallic phase is composed of a metal from the platinum group that is stable at sintering temperature.

5. The spark plug according to claim 4, wherein the metallic phase is composed of platinum or a platinum alloy.

6. The spark plug according to claim 1, wherein a ceramic granulated material is used to produce the cermet (28), wherein granules of the granulated material are provided with a surface coating of the material having good electrical conductivity.

7. The spark plug according to claim 6, wherein the granulated material has a granule size in a range between 90 μm and 150 μm.

8. The spark plug according to claim 6, wherein the material having good electrical conductivity is pulverized, and the individual particles are less than 10 μm in size.

9. The spark plug according to claim 1, wherein the center electrode (18) has a diameter between 0.3 mm and 0.8 mm.

10. A method for producing a spark plug using the following steps:

pressing a ceramic material to form an insulator (18) that is provided with a location hole (36) for a center electrode;

inserting a center electrode (18) in the location hole;

providing a cermet between the center electrode and a terminal stud of the insulator;

filling and compacting a ceramic granulated material in the insulator, wherein granules of the granulated material are provided with a coating of a material having good electric conductivity, in the insulator and compacted;

sintering the insulator;

locating a burn-off resistor (30) in the interior of the insulator; and providing a conductive phase of the burn-off resistor of carbon.

11. The method according to claim 10, wherein $Al_2O_3$ is used as the ceramic material.

12. The method according to claim 11, wherein sintering auxiliary agents are used.

13. The method according to claim 11, wherein $Al_2O_3$ is used as the material for the insulator.

14. The method according to claim 10, wherein a metal from the platinum group that is stable at sintering temperature is used as the material having good electrical conductivity.

15. The method according to claim 14, wherein platinum or a platinum alloy is used as the material having good electrical conductivity.

16. The method according to claim 10, wherein the granules of the ceramic granulated material are coated with the material having good electrical conductivity by stirring in a diluted suspension.

17. The method according to claim 10, wherein the material having good electrical conductivity is applied to the granules of the granulated material using a binding agent.

18. The method according to claim 17, wherein the binding agent is an organic binding agent.

19. The method according to claim 10, wherein the material having good electrical conductivity is applied to the granules of the granulated material via vapour deposition.

20. The method according to claim 10, wherein the material having good electrical conductivity is applied to the granules of the granulated material via sputtering.

* * * * *